US006107973A

United States Patent [19]

Knop et al.

[11] Patent Number: 6,107,973

[45] Date of Patent: Aug. 22, 2000

[54] DUAL-REFLECTOR MICROWAVE ANTENNA

[75] Inventors: Charles M. Knop; Gregory S. Orseno, both of Lockport, Ill.; D. John Cole, Dunfermline, United Kingdom

[73] Assignee: Andrew Corporation, Orland Park, Ill.

[21] Appl. No.: 09/022,652

[22] Filed: Feb. 12, 1998

Related U.S. Application Data

[60] Provisional application No. 60/037,205, Feb. 14, 1997.

[51] Int. Cl.[7] ..... H01Q 19/18

[52] U.S. Cl. ..... 343/781 P; 343/781 CA

[58] Field of Search ..... 343/781 CA, 781 P, 343/837, 840; H01Q 15/02, 19/18

[56] References Cited

U.S. PATENT DOCUMENTS

| | | | |
|---|---|---|---|
| 3,983,560 | 9/1976 | MacDougall | 343/781 |
| 4,626,863 | 12/1986 | Knop et al. | 343/781 |
| 5,486,838 | 1/1996 | Dienes | 343/781 |

FOREIGN PATENT DOCUMENTS

| | | |
|---|---|---|
| 75 37318 | 12/1975 | France . |
| 2540297A | 8/1994 | France . |
| 1801706 | 6/1970 | Germany . |
| 2715796A | 10/1978 | Germany . |
| 3533211A | 3/1987 | Germany . |
| 3823056A | 1/1990 | Germany . |
| 973583A | 10/1964 | United Kingdom . |
| 2155245A | 9/1985 | United Kingdom . |
| 2161324A | 1/1986 | United Kingdom . |

OTHER PUBLICATIONS

ETS 300197: Transmission and Multiplexing (TM); Parameters for radio relay systems for the transmission of digital signals and analogue video signals operating at 38 GHz, Paragraphs 4.5–4.9, ETSI Apr. 1994.

*Primary Examiner*—Michael C. Wimer
*Attorney, Agent, or Firm*—Jenkens & Gilchrist

[57] ABSTRACT

A dual-reflector microwave antenna comprises the combination of a paraboloidal main reflector having an axis; a waveguide and dual-mode feed horn extending along the axis of the main reflector, a subreflector for reflecting radiation from the feed horn onto the main reflector in the transmitting mode, and a shield extending from the outer edge of the main reflector and generally parallel to the axis of the main reflector, the inside surface of the shield being lined with absorptive material for absorbing undesired radiation. The subreflector is shaped to produce an aperture power distribution that is substantially confined to the region of the main reflector outside the shadow of the subreflector. The support for the subreflector is preferably a hollow dielectric cone having a resonant thickness to cause energy passing through said cone to be in phase with energy reflected off of said cone so as to achieve phase cancellation.

14 Claims, 8 Drawing Sheets

DUAL-REFLECTOR MICROWAVE ANTENNA

CROSS-REFERENCE TO RELATED APPLICATIONS

This application claims the benefit of priority of U.S. Provisional Patent Application Ser. No. 60,037,205 filed on Feb. 14, 1997.

FIELD OF THE INVENTION

The invention relates generally to microwave antennas, and, more particularly, to microwave antennas of the type that include a paraboloidal reflector with a feed arrangement that includes a shaped subreflector (splash plate) and a dual mode feed horn.

BACKGROUND OF THE INVENTION

The typical geometry of a conventional hyperbolic Cassegrain antenna comprises a primary feed horn, a hyperbolic subreflector, and a paraboloidal main reflector. The central portion of the hyperbolic subreflector is shaped and positioned so that its virtual focal point is coincident with the phase center of the feed horn and its real focal point is coincident with the virtual focal point of the parabolic main reflector. In the transmitting mode, the feed horn illuminates the subreflector, the subreflector reflects this energy in a spherical wave about its real focal point to illuminate the main reflector, and the main reflector converts the spherical wave to a planar wave across the aperture of the main reflector. To suppress wide angle radiation, the antenna employs a cylindrical absorber-lined shield on the main reflector. In the receiving mode, the parabolic main reflector is illuminated by an incoming planar wave and reflects this energy in a spherical wave to illuminate the subreflector, and the subreflector reflects the incoming energy into the feed hom.

The geometry of a typical prime-fed antenna comprises a feed horn with a button-hook, and a parabolic main reflector. The central portion of the parabolic main reflector is shaped and positioned so that its virtual focal point is coincident with the phase center of the feed horn. In the transmitting mode, the feed horn illuminates the main reflector, and the main reflector radiates a planar wave across the aperture of the main reflector. To suppress wide angle radiation, the antenna employs a cylindrical absorber-lined shield on the main reflector. In the receiving mode, the parabolic main reflector is illuminated by an incoming planar wave and reflects the incoming energy into the feed horn.

Usually, the above antennas must radiate substantially symmetrical patterns with equal E-plane and H-plane radiation patterns. The E-plane pattern corresponds to horizontal polarization and the H-plane pattern corresponds to vertical polarization. To radiate symmetrical patterns from either the hyperbolic Cassegrain antennas or the prime-fed antenna, the feed horn must radiate approximately equal E-plane and H-plane patterns. A corrugated horn radiates approximately symmetrical radiation patterns; however, a corrugated horn is not a preferred design choice because of its high construction cost, especially at millimeter wavelength frequencies corresponding to 20 to 60 gigahertz ("GHz" hereafter) range. Instead of implementing the costly corrugated horn, a dual mode ("DM" hereafter) horn may be used. The DM horn radiates $TE_{11}$ and $TM_{11}$ modes and has a low construction cost.

SUMMARY OF THE INVENTION

It is a primary object of this invention to provide a microwave antenna that has a high efficiency and very low wide angle radiation with a short shield length.

Another object of this invention is to provide such an antenna that has a low manufacturing cost.

A further object of this invention is to provide such an antenna that has low wind loading.

In accordance with the present invention, the foregoing objectives are realized by providing a dual-reflector microwave antenna comprising the combination of a paraboloidal main reflector having an axis; a waveguide and dual-mode feed horn extending along the axis of the main reflector, a subreflector for reflecting radiation from the feed horn onto the main reflector in the transmitting mode, and a shield extending from the outer edge of the main reflector and generally parallel to the axis of the main reflector, the inside surface of the shield being lined with absorptive material for absorbing undesired radiation. The subreflector is shaped to produce an aperture power distribution that (1) is substantially confined to the region of the main reflector outside the shadow of the subreflector, (2) tapers off sharply adjacent the outer edge of the main reflector, and (3) tapers off sharply adjacent the outer edge of the shadow of said subreflector on said main reflector. The support for the subreflector is preferably a hollow dielectric cone having a resonant thickness to cause energy passing through said cone to be in phase with energy reflected off of said cone so as to achieve phase cancellation. In a preferred embodiment, the hollow support cone is concentric with the feed horn and connected between the outer surface of the waveguide and the outer edge of the subreflector. The feed horn is preferably a DM feed horn.

Other objects and advantages of the invention will be apparent from the following detailed description and the accompanying drawings.

DETAILED DESCRIPTION OF PREFERRED EMBODIMENT

Figure 2:
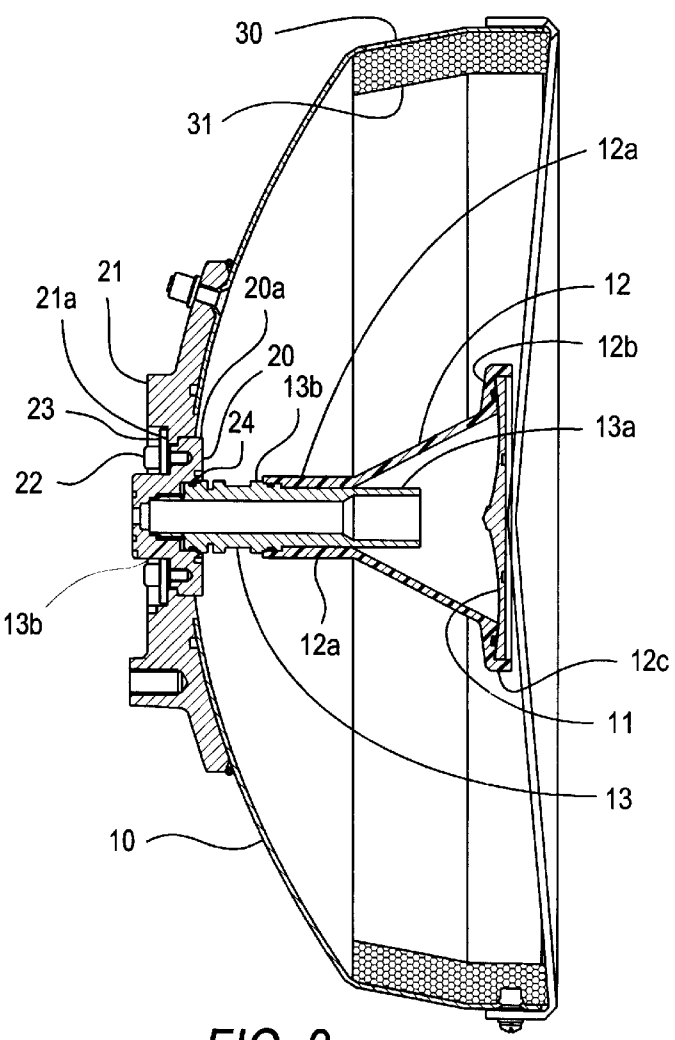
FIG. 2 is a vertical section taken generally along line 2—2 in FIG. 1.
Figure 1:
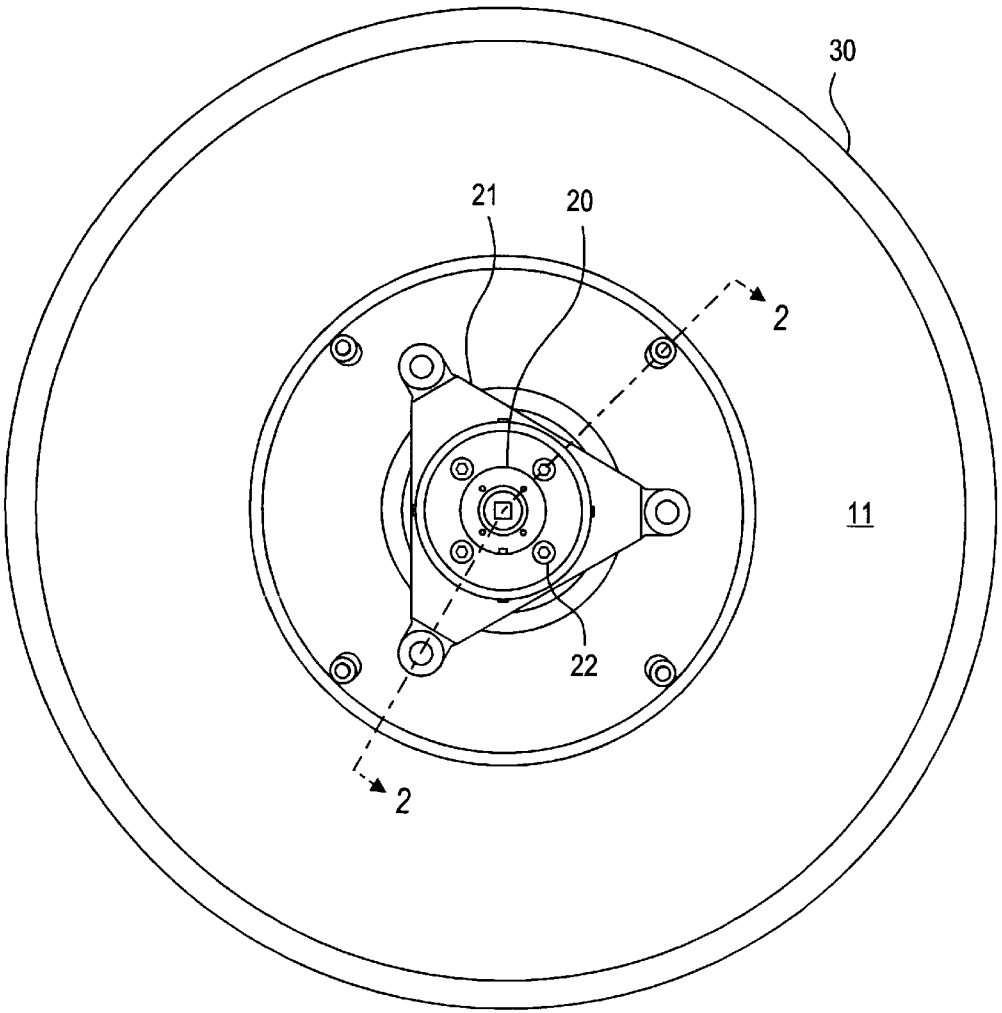
FIG. 1 is a rear elevation of a microwave antenna embodying the present is invention.

While the invention will be described in connection with certain preferred embodiments, it will be understood that it is not intended to limit the invention to those particular embodiments. On the contrary, it is intended to cover all alternatives, modifications and equivalents as may be included within the spirit and scope of the invention as defined by the appended claims.

Turning now to the drawings and referring first to FIGS. 1–5, a dual-reflector microwave antenna includes a paraboloidal main reflector 10, a shaped subreflector 11, a hollow dielectric support cone 12 and a waveguide 13 forming a DM feed horn 13*a* extending along the axis of the main reflector 10. In the transmitting mode, the DM feed horn 13*a* illuminates the subreflector 11 which reflects this energy in a spherical wave to illuminate an annular region of the main reflector 10, which in turn converts the spherical wave to a planar wave perpendicular to the axis of the main reflector across the aperture of the reflector. In the receiving mode, the main reflector 10 is illuminated by an incoming planar wave and reflects this energy in a spherical wave to illuminate the subreflector 11, which in turn reflects the incoming energy into the feed horn 13*a*. (The term "feed" as used herein, although having an apparent implication of use in a transmitting mode, will be understood to encompass use in a receiving mode as well, as is conventional in the art.)

The waveguide 13 is supported by a central hub 20 mounted in an aperture in the center of a mounting plate 21 attached to the main reflector 10. The hub 20 includes a flange 20*a* which is held against one side of a flange 21*a* on the plate 21 by means of four bolts 22 passing through a disc 23 and threaded into the hub flange 20*a*. As the bolts 22 are tightened, they draw the hub flange 20*a* and the disc 23 tightly against opposite sides of the flange 21*a*. The waveguide 13 is secured to the hub by threads 13*b* on the outer surface of an end portion of the waveguide, which mate with corresponding threads on the inside surface of the hub 20. An O-ring 24 blocks the entry of moisture into the interface between the waveguide and the hub. It will be noted that the exposed surfaces of the hub 20 and the mounting plate 21 on the side of the main reflector I 0 facing the subreflector are confined to an area that is smaller than the shadow of the subreflector on the main reflector, i.e., smaller than the diameter of the subreflector and its supporting structure.

In order to support the subreflector 11 in the desired position relative to the main reflector 10 and the feed horn 13*a*, the subreflector is mounted on the wide end of the hollow dielectric cone 12, which is fastened at its smaller end to the outer surface of the waveguide 13. Specifically, the small end of the hollow cone 12 terminates in a cylindrical sleeve 12*a* having internal threads for engaging external threads on the waveguide 13. A stop flange 13*c* on the waveguide determines the final position of the hollow cone 12 along the length of the waveguide, and an O-ring 25 is preferably mounted in the interface between the waveguide and the sleeve 12*a* to prevent the migration of moisture into the interior of the subsystem comprising the waveguide, the feed horn, the hollow support cone and the subreflector. The resonant thickness of the hollow dielectric cone 12 is preferably selected to cause energy passing through the hollow cone to be in phase with energy reflected off the hollow cone so as to achieve phase cancellation. The hollow dielectric cone is preferably molded of a suitable dielectric material that is thermally stable and will not absorb moisture, so that it provides mechanical integrity, stability and strength to the antenna To facilitate attachment of the subreflector to the supporting hollow cone 12, the wide end of the hollow cone 12 terminates in an outwardly extending flange 12*b* forming a recess that is complementary to the outer peripheral portion of the subreflector. Specifically, the flange 12*b* extends along the outer edge of the subreflector and an adjacent peripheral portion of the subreflector surface facing the hollow cone 12. Cooperating threads are formed on the opposed surfaces of the outer periphery of the subreflector 11 and a lip 12*c* on the outer end of the flange 12*b* so that these two parts can be simply threaded together. An O-ring 26 between the opposed surfaces of the flange 12*b* and the subreflector 11 prevents the migration of moisture through that interface.

The subreflector is shaped so that (1) substantially the entire radiation reflected by the subreflector illuminates the portion of the main reflector 10 between the outer edge of the main reflector and the outer edge of the shadow of the subreflector on the main reflector, and (2) the aperture power distribution is approximately constant across the major portion, preferably at least two-thirds of the area, of the illuminated region of the main reflector 10. The aperture power distribution preferably drops off sharply at both the inner and outer edges of the illuminated area of the main reflector 10. One specific example of such an aperture power distribution is illustrated in FIG. 6, where the desired power $P_A$ is plotted as a function of the normalized distance off the aperture axis, or X/(D/2) where X is the distance off the aperture axis and D is the diameter of the main reflector.

Figure 7:
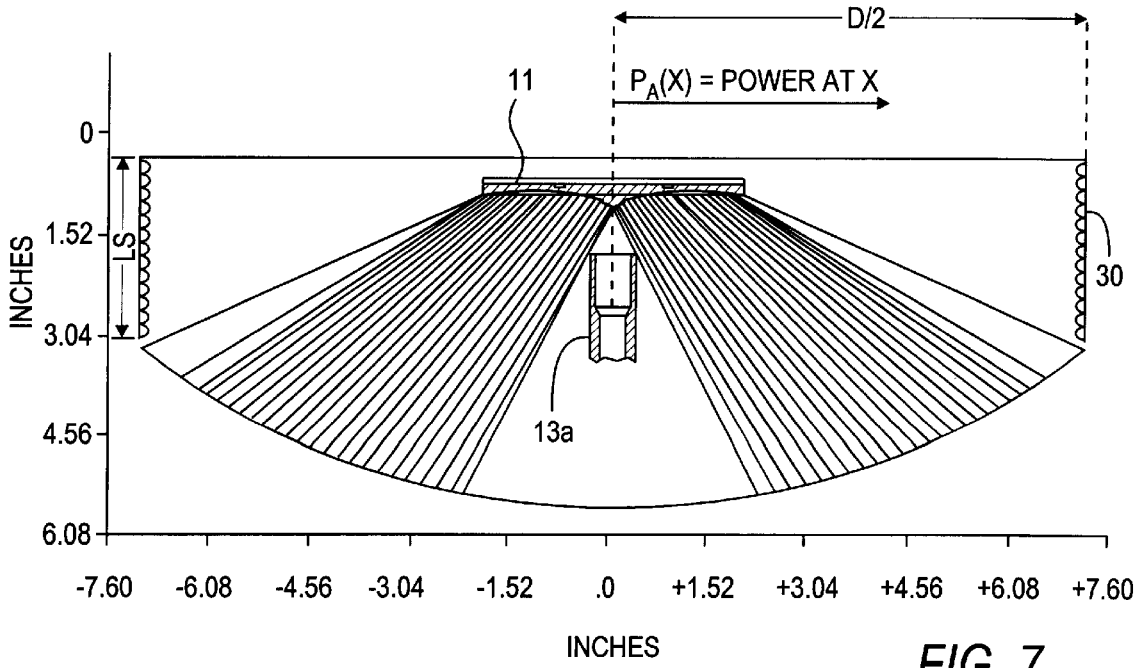
FIG. 7 is a ray distribution diagram for the antenna of FIGS. 1–5.

The corresponding ray distribution between the subreflector 11 and the main reflector 10 is illustrated in FIG. 7. It can be seen that the generally concave shape between the center and outer edge of the subreflector produces an annular beam that confines the illumination of the main reflector to an annular region between the subreflector shadow and the outer edge of the main reflector.

Figure 6:
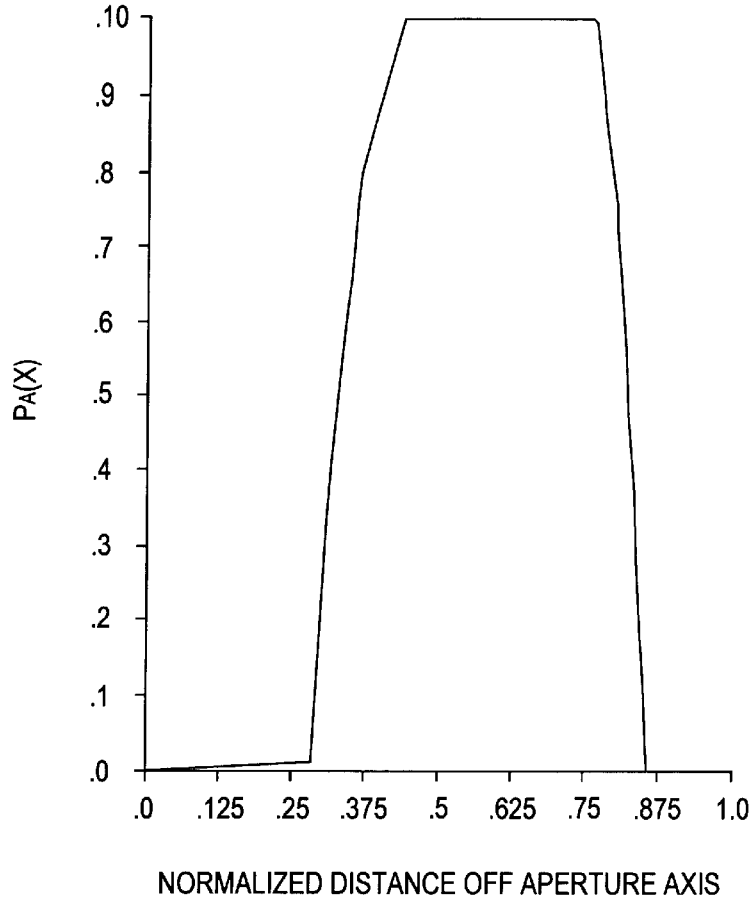
FIG. 6 is a desired aperture power distribution across half of the aperture, i.e., along a radius, of the main reflector of the antenna of FIGS. 1–5.

To obtain the correct shape of the subreflector 11 that yields the desired aperture power distribution of FIG. 6, the following conditions must be simultaneously satisfied: (1) power conservation of the feed horn's energy after reflection off the subreflector and main reflector, (2) invoking Snell's Law at the subreflector and main reflector, and (3) realizing approximately constant phase across the illuminated portion of the reflector aperture. These three conditions provide differential equations which can be solved to determine the optimum shapes for the main reflector and the subreflector. Once the shapes are determined, a best fit parabola can be used for the actual shape of the main reflector.

To suppress wide angle radiation, the antenna of FIGS. 1–5 employs a cylindrical absorber-lined shield 30 lined with absorber material 31 for absorbing undesired radiation. In the preferred embodiment illustrated in the drawings the shield 30 is formed as an integral part of the main reflector 10, extending from the outer edge of the main reflector and generally parallel to the axis of the main reflector. One advantage of the antenna of this invention is that the length of the absorber-lined shield can be significantly reduced as compared to the shields required for previous hyperbolic Cassegrain antennas or prime-fed antennas. Because the shaped subreflector 11 provides rapid power fall-off at the reflector's edge, the length of the absorber-lined shield needed for absorbing wide angle radiation is significantly reduced. For example, a typical twelve-inch reflector aperture diameter, the length of the absorber-lined shield is approximately three inches for the antenna of this invention, as compared to eight to ten inches for a prime-fed antenna or six to eight inches for a hyperbolic Cassegrain antenna. The reduced length of the absorber-lined shield reduces wind loading on the antenna and improves the antenna's environmental and aesthetic appearance.

An additional advantage of the shaped subreflector used in the antenna of this invention is that it provides a small Voltage Standing Wave Ratio ("VSWR") and improved radiation patterns. The shaped subreflector scatters very little energy back into the horn region or shadow region of the antenna. Because energy scattered off the horn and subreflector shadow causes the degradation of radiation patterns, the shaped subreflector reduces the VSWR and improves the patterns radiated.

Figure 3:
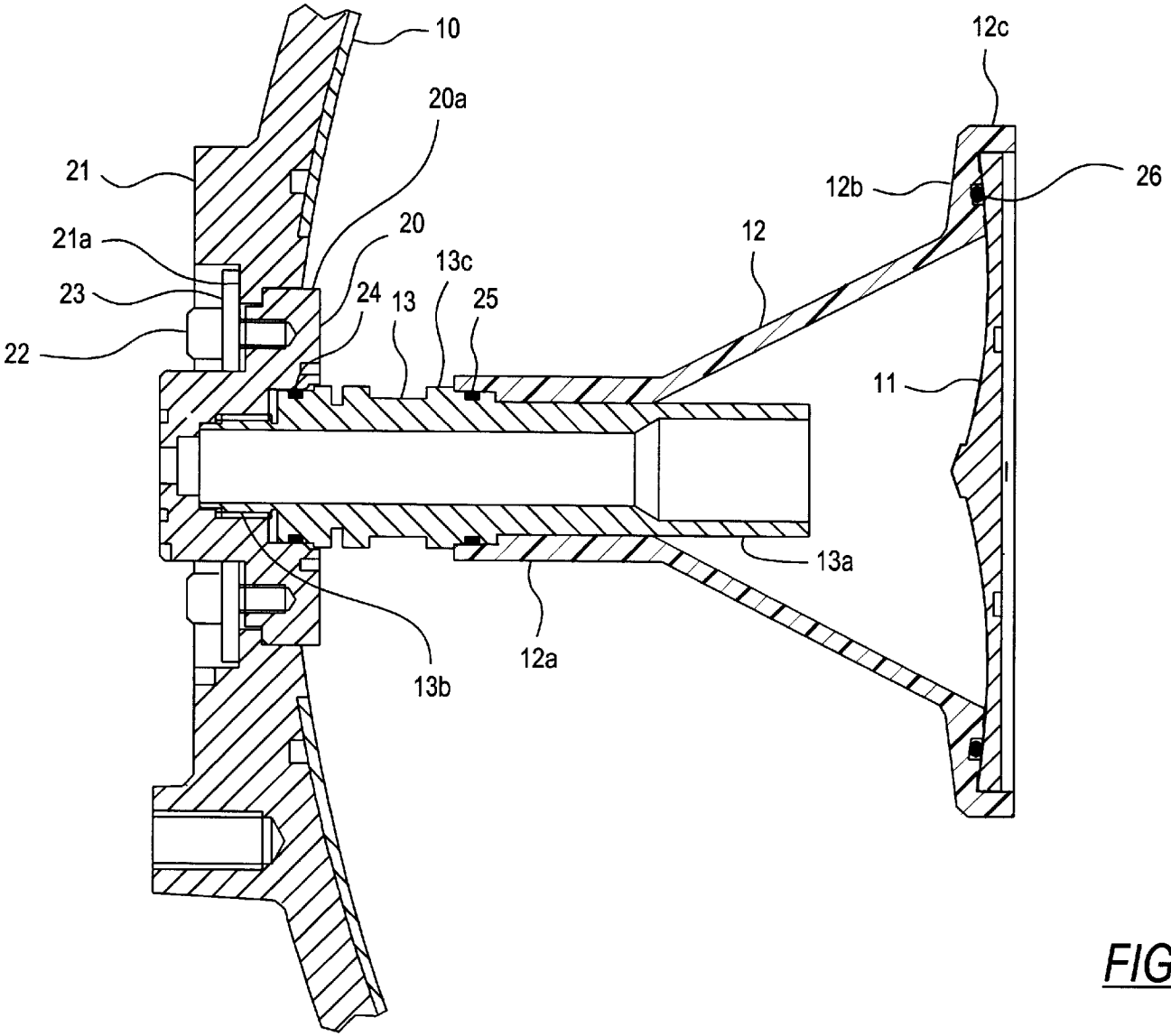
FIG. 3 is an enlarged view of the feed portion of the antenna of FIGS. 1 and 2.
Figure 4:
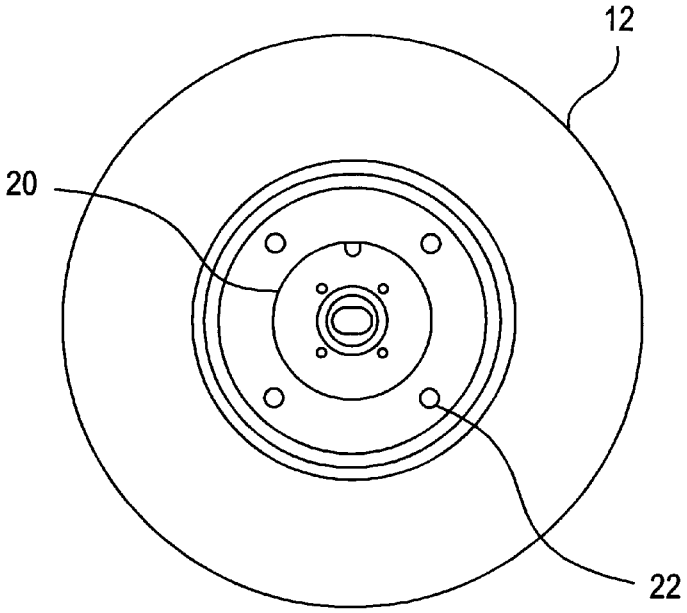
FIG. 4 is an elevation taken from the left-hand side of the feed arrangement as viewed in FIG. 2.
Figure 5:
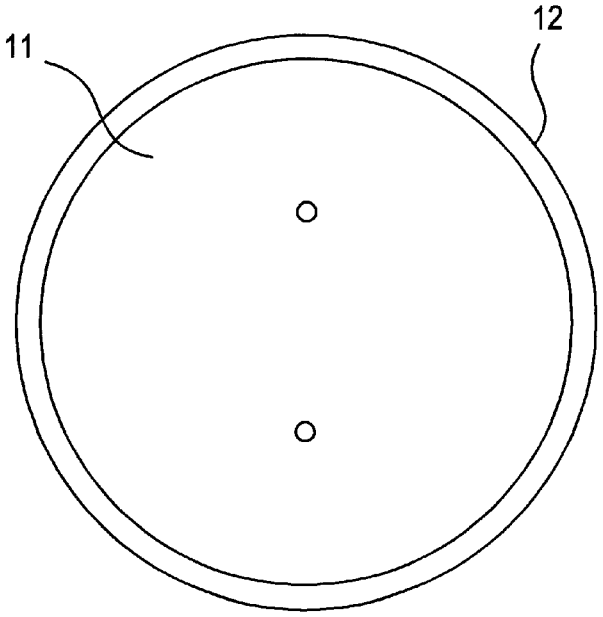
FIG. 5 is an elevation taken from the right-hand side of the feed arrangement as viewed in FIG. 2.
Figure 8A:
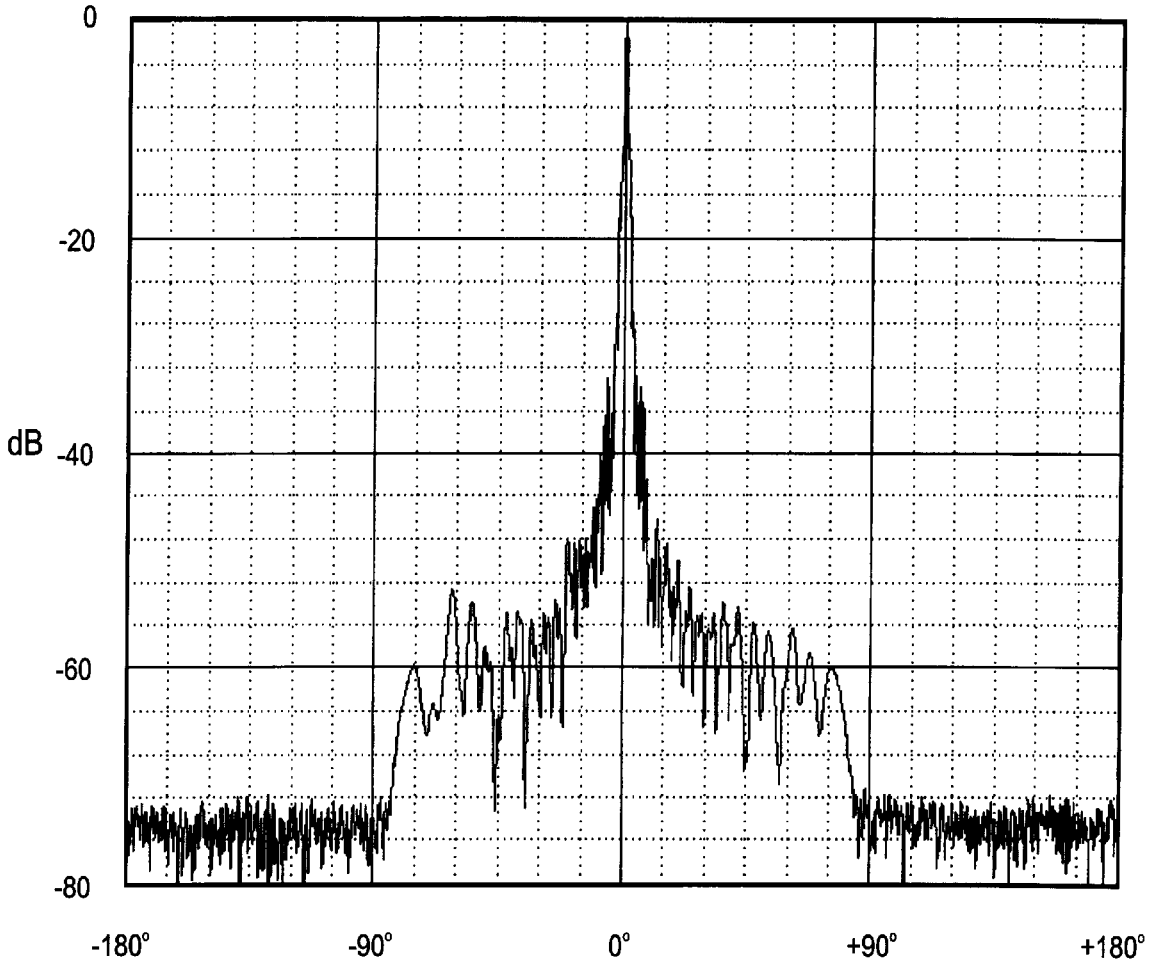
FIGS. 8*a* and 8*b* are graphs of measured E-plane and H-plane co-polar radiation patterns for the microwave antenna of FIGS. 1–5 operated at 38.25 GHz.
Figure 8B:
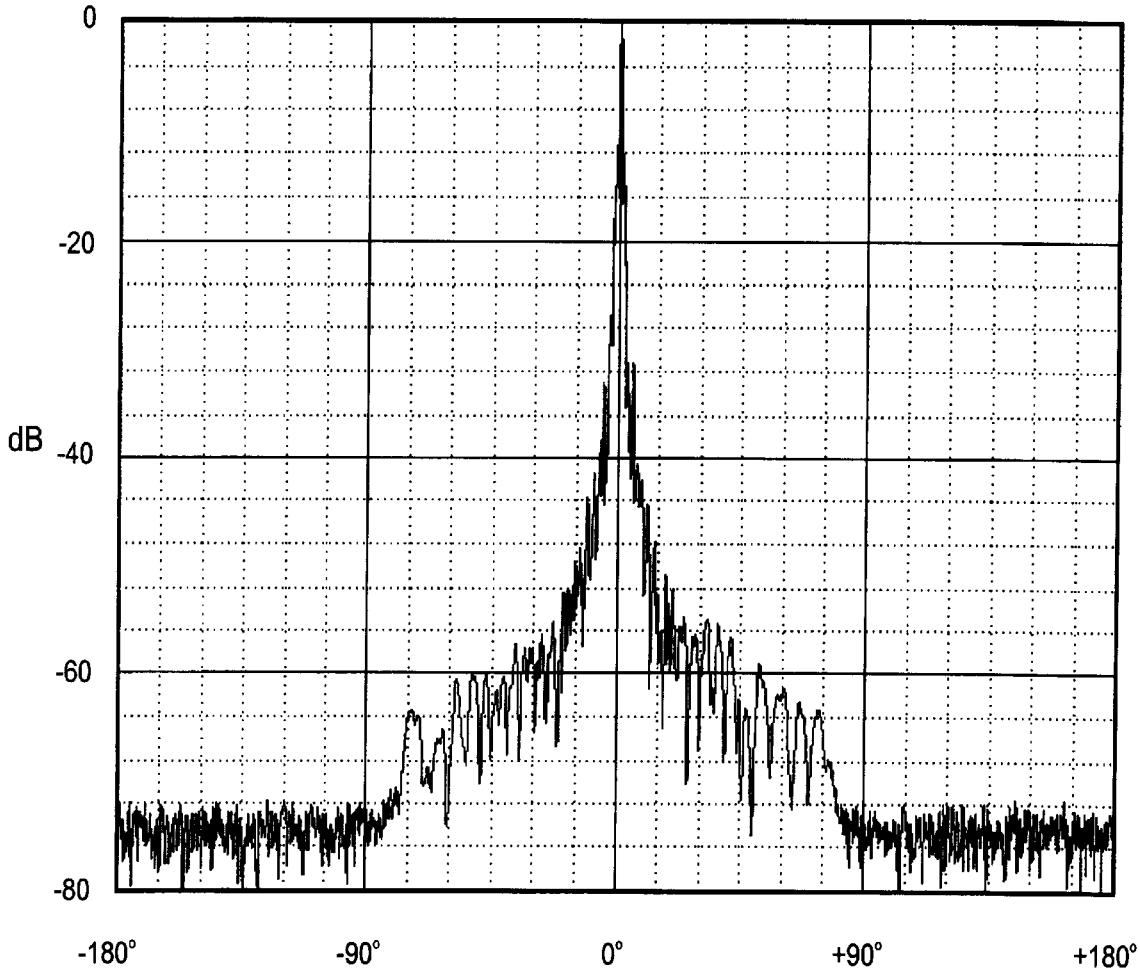
Figure 9A:
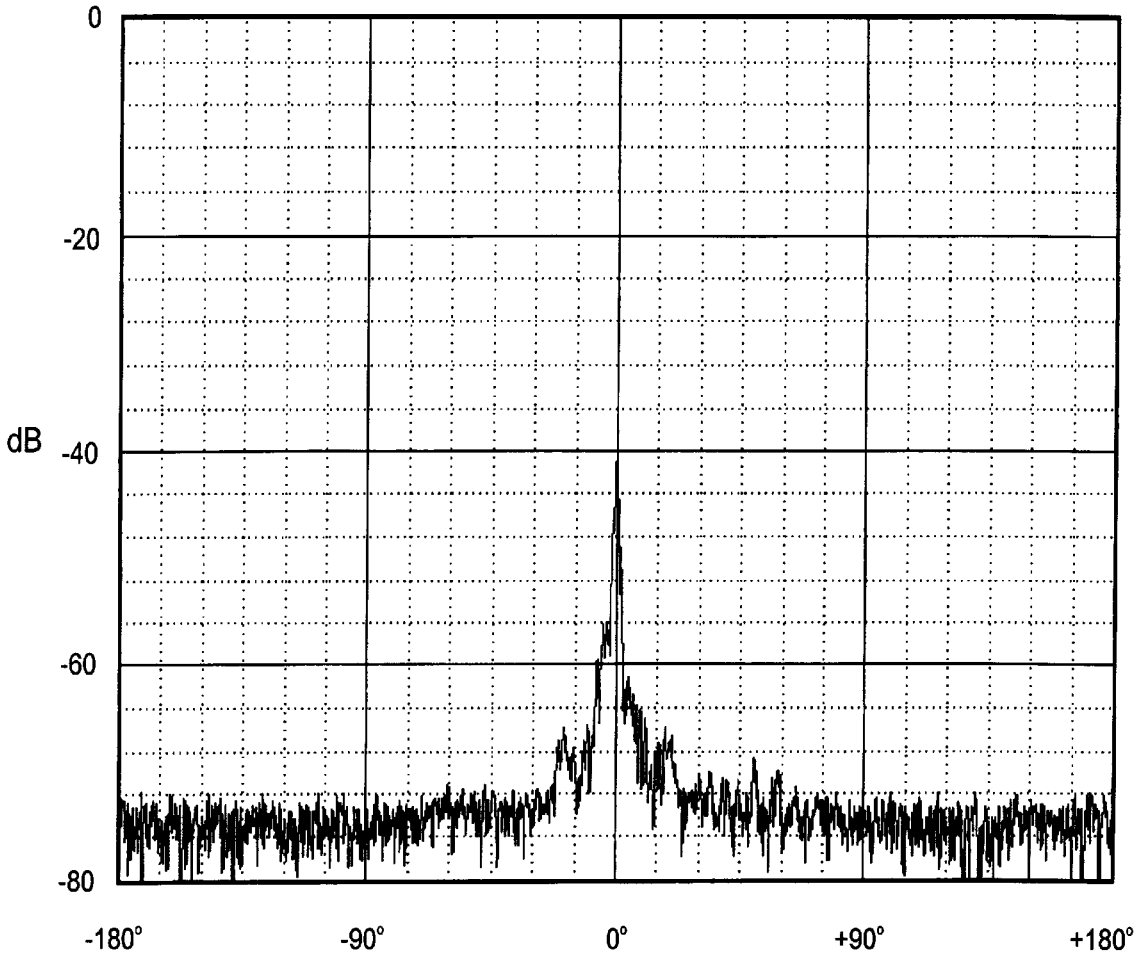
FIGS. 9*a* and 9*b* are graphs of measured E-plane and H-plane cross-polar radiation patterns for the microwave antenna of FIG. 1 operated at 38.25 GHz.
Figure 9B:
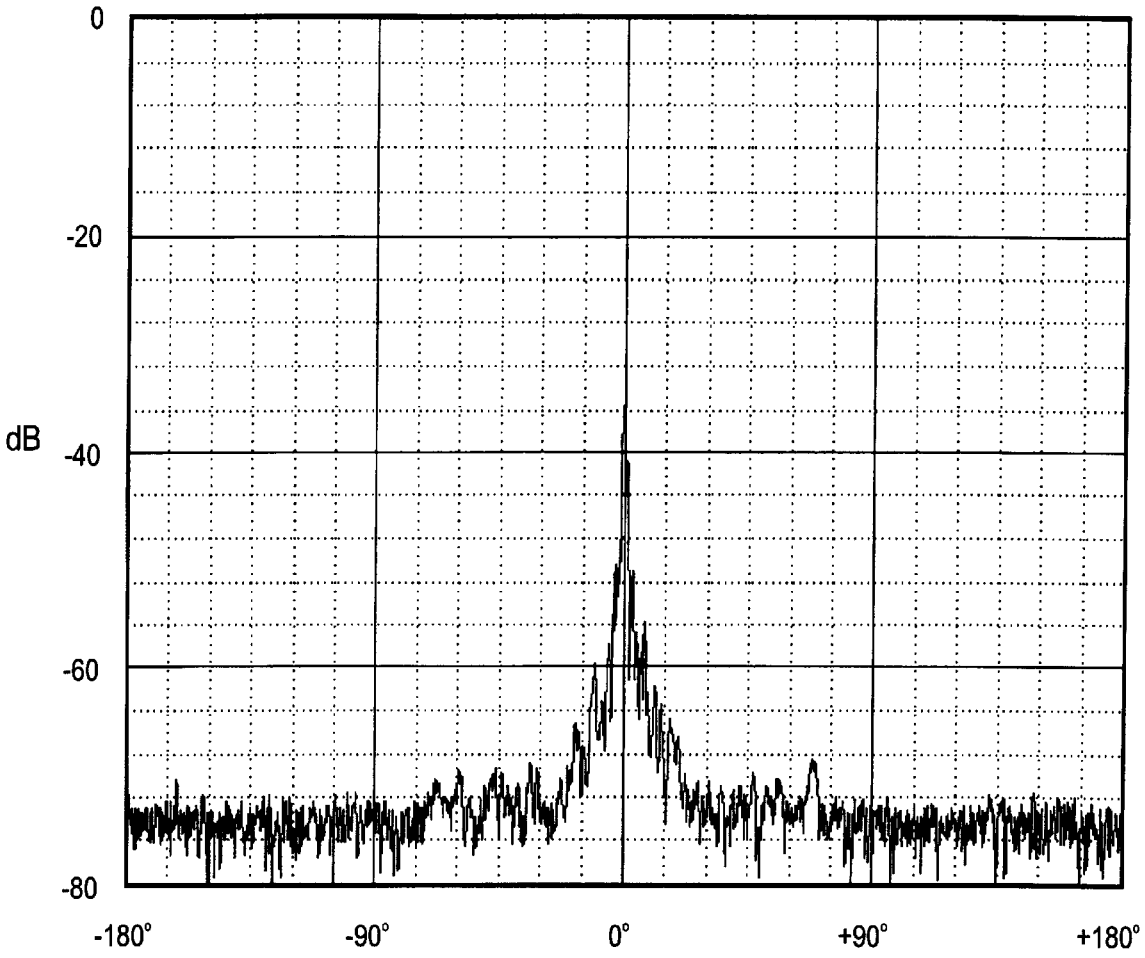

FIGS. 8*a* and 8*b* are graphs of measured E-plane and H-plane co-polar radiation patterns for the microwave antenna of FIGS. 1–5 operated at 38.25 GHz, and FIGS. 9*a* and 9*b* are graphs of the corresponding measured E-plane and H-plane cross-polar radiation patterns. Both the E-plane and H-plane patterns meet the requirements currently imposed by the European Telecommunication Standards Institute (ETSI) in Europe and the FCC in the United States. The patterns are also highly directional. Although the illustrative patterns were produced at a frequency of 38.25 GHz, similar results can be obtained across the microwave frequency range extending from about 2 GHz to about 60 GHz by simply modifying the dimensions of the DM feed horn and the shape of the subreflector. Moreover, the particular subreflector shape illustrated in FIGS. 2 and 3 is suitable for use over a frequency range extending from about 22 GHz to about 40 GHz with appropriate modification of the dimensions of the DM feed horn.

Thus it can be seen that the antenna described above provides a low-cost microwave antenna that has a high directive efficiency and low wide-angle radiation with very small shield lengths. The small shield length in turn provides low wind loading on the antenna which reduces the cost of the supporting structure required for the antenna.

What is claimed is:

1. A dual-reflector microwave antenna for use in terrestrial communication systems, said antenna comprising the combination of a paraboloidal main reflector having an axis;

a waveguide and dual-mode feed horn extending along the axis of said main reflector, a subreflector for reflecting radiation from said feed horn onto said main reflector in the transmitting mode, said subreflector being shaped to produce an aperture power distribution that (1) is substantially confined to the region of said main reflector outside the shadow of said subreflector, (2) tapers off sharply adjacent the outer edge of the main reflector, and (3) tapers off sharply adjacent the outer edge of the shadow of said subreflector on said main reflector, and a shield extending from the outer edge of said main reflector and generally parallel to the axis of the main reflector, the inside surface of said shield being lined with absorptive material for absorbing undesired radiation.

2. The antenna of claim 1 wherein said shield terminates in a plane that is perpendicular to the axis of the main reflector and only slightly farther away from the center of the main reflector than the reflecting surface of the subreflector.

3. The antenna of claim 1 wherein said subreflector is shaped to reflect energy from said horn in an annular beam confined substantially to the region of the main reflector outside the shadow of the subreflector.

4. The antenna of claim 1 wherein the surface of said subreflector facing said main reflector is generally concave between the center and the outer edge of the subreflector.

5. The antenna of claim 1 which includes dielectric supporting means connected between the outer surface of said waveguide and the outer edge of said subreflector for mounting the subreflector on the waveguide.

6. The antenna of claim 5 wherein said dielectric supporting means comprises a hollow cone having a resonant thickness to cause energy passing through said cone to be in phase with energy reflected off of said cone so as to achieve phase cancellation.

7. The antenna of claim 1 wherein said waveguide is attached to and supported by a hub at the center of said main reflector.

8. A dual-reflector microwave antenna for use in terrestrial communication systems, said antenna comprising the combination of a paraboloidal main reflector having an axis;

a waveguide and feed horn extending along the axis of said main reflector, a subreflector for reflecting radiation from said feed horn onto said main reflector in the transmitting mode, said subreflector being shaped to produce an aperture power distribution that (1) is substantially confined to the region of said main reflector outside the shadow of said subreflector, (2) tapers off sharply adjacent the outer edge of the main reflector, and (3) tapers off sharply adjacent the outer edge of the shadow of said subreflector on said main reflector, and a hollow dielectric cone concentric with said feed horn for supporting said subreflector, said cone having a resonant thickness to cause energy passing through said cone to be in phase with energy reflected off of said cone so as to achieve phase cancellation.

9. The antenna of claim 8 which includes a shield extending from the outer edge of said main reflector and generally parallel to the axis of the main reflector, the inside surface of said shield being lined with absorptive material for absorbing undesired radiation.

10. The antenna of claim 8 wherein said hollow dielectric cone is attached to the outer surface of said waveguide.

11. The antenna of claim 9 wherein said shield terminates in a plane that is perpendicular to the axis of the main reflector and only slightly farther away from the center of the main reflector than the reflecting surface of the subreflector.

12. The antenna of claim 8 wherein said subreflector is shaped to reflect energy from said horn in an annular beam confined substantially to the region of the main reflector outside the shadow of the subreflector.

13. The antenna of claim 8 wherein the surface of said subreflector facing said main reflector is generally concave between the center and the outer edge of the subreflector.

14. The antenna of claim 8 wherein said waveguide is attached to and supported by a hub at the center of said main reflector.

* * * * *